US005222291A

United States Patent [19]

Ota et al.

[11] Patent Number: 5,222,291

[45] Date of Patent: Jun. 29, 1993

[54] METHOD OF MAKING UNIT HEADS FOR DIVISIONAL-TYPE THERMAL HEAD

[75] Inventors: Shigeo Ota; Fumiaki Tagashira; Shingo Ooyama, all of Kyoto, Japan

[73] Assignee: Rohm Co., Ltd., Kyoto, Japan

[21] Appl. No.: 861,905

[22] Filed: Apr. 1, 1992

[30] Foreign Application Priority Data

May 8, 1991 [JP] Japan ..... 3-102743
Jan. 30, 1992 [JP] Japan ..... 4-014985

[51] Int. Cl.[5] ..... H05B 3/00

[52] U.S. Cl. ..... 29/611; 29/414; 346/76 PH

[58] Field of Search ..... 29/611, 890.1, 413, 29/414; 346/76 PH

[56] References Cited

FOREIGN PATENT DOCUMENTS 157885 8/1985 Japan ..... 346/76 PH 63-11993 3/1988 Japan .

*Primary Examiner*—P. W. Echols

*Attorney, Agent, or Firm*—William H. Eilberg

[57] ABSTRACT

A method is provided for making unit heads from a material head. The unit heads are used to constitute a divisional-type thermal head. The material head includes an elongate insulating substrate carrying a longitudinal array of heating dot portions, and a protective layer extending longitudinally of the material head to cover the array of heat dot portions. According to the method, the material head is cut along at least one cutting line which extends transversely of the material head at a position between two adjacent heating dot portions, wherein the protective layer has cutouts which extend from the respective longitudinal edges of the protective layer toward the array of heating dot portions at the position of the cutting line.

7 Claims, 6 Drawing Sheets

METHOD OF MAKING UNIT HEADS FOR DIVISIONAL-TYPE THERMAL HEAD

BACKGROUND OF THE INVENTION

1. Field of the Invention

This invention relates generally to thermal heads which are widely used in facsimile machines, word processors and so forth. More specifically, the invention relates to a method of making unit heads which are arranged in series in an optional number to constitute a divisional-type thermal head of a desired length.

2. Description of the Prior Art

As is well known, thermal heads are widely used to print information on papers of various sizes. Thus, the length of the thermal head must be adjusted depending on the particular paper size to which the thermal head is applied.

However, if the paper size is too large, it becomes difficult or impractical to increase the length of a single thermal head to suit the excessively large paper size. Further, it is technically disadvantageous to provide thermal heads of various sizes due to the necessity of redesigning upon every change in size.

In view of the above problem, it has been proposed to constitute a thermal head of a desired length by incorporating a series of standardized unit heads in a selected number. Such a thermal head is called "divisional-type thermal head".

For convenience of explanation, an example of divisional-type thermal head is shown in FIG. 7 of the accompanying drawings, whereas a unit head to be incorporated in the divisional-type thermal head is illustrated in FIG. 8.

As shown in FIG. 7, the divisional-type thermal head has a support plate B on which a plurality of unit heads A" (see FIG. 8) are arranged in series. Each unit head A" has a length (unit printing length) s, so that the divisional-type thermal head provides an overall printing length S which is a multiple of the unit printing length s. Therefore, the overall printing length S can be optionally adjusted by selecting the number of unit heads A" without changing the length of each unit head itself.

A method of making such unit heads is disclosed in Japanese Patent Publication No. 63-11993 for example. For convenience, the method disclosed in this publication is illustrated in FIG. 9 of the accompanying drawings.

As shown in FIG. 9, a material head A0 is first prepared for subsequent making of unit heads A" (see also FIG. 8). The material head comprises an elongate insulating substrate 1 having a length L and a width W, and a longitudinal array of heating dot portions 3 formed on the substrate 1 and respectively connected to pairs of electrodes 4, 5. The material head further comprises a protective layer 6 extending longitudinally of the substrate 1 to cover the heating dot portions 3 and the electrodes 4, 5.

Then, the material head A0 is cut along cutting lines C each extending transversely of the substrate 1 at a position between two adjacent heating dot portions. The cutting may be performed by using a rotary diamond cutter (not shown) for example. As a result, a plurality of unit heads A" are provided for subsequent incorporation into a divisional-type thermal head.

The protective layer 6 of the material head A0 is usually made of a hard but brittle material such as glass.

Thus, at the time of cutting the material head, the protective layer is inevitably subjected to chipping at the cut edges extending along the respective cutting lines C. If such chipping is excessive, the heating dot portions 3 and electrodes 4, 5 located near the cutting lines may partially come off with the chips. Further, similar chipping also occurs during subsequent handling and transportation of the divided unit heads A". Therefore, the unit heads are liable to a quality problem.

Obviously, if the width of the protective layer 6 is rendered small, the degree of chipping reduces. However, such width reduction detracts from the protective function of the protective layer.

Moreover, when the substrate 1 itself is formed with a glaze layer 2 of e.g. glass (as often required for surface conditioning), the problem of chipping also occurs with respect to the glaze layer. Indeed, the glaze layer 2 will have a width corresponding to that of the substrate 1, so that the chipping problem is additionally serious.

SUMMARY OF THE INVENTION

It is, therefore, an object of the present invention to provide a method of making unit heads from a material head wherein the material head is rendered much less liable to chipping at the time of and after cutting the material head.

According to the present invention, there is provided a method of making unit heads for a divisional-type thermal head from a material head, the material head comprising an elongate insulating substrate which carries a longitudinal array of heating dot portions arranged at suitable pitch and pairs of electrodes connected to the respective dot portions, the material head further comprising a protective layer extending longitudinally of the material head to cover the array of heat dot portions and the pairs of electrodes, the method comprising dividing the material head into a plurality of unit heads by cutting the material head along at least one cutting line which extends transversely of the material head at a position between two adjacent heating dot portions, wherein the protective layer has a cutout which extends from at least one longitudinal edge of the protective layer toward the array of heating dot portions at the position of the cutting line.

According to the method of the present invention, the width of the protective layer can be greatly reduced by the provision of the cutout at the cutting line. Thus, the protective layer is less subjected to chipping at the time of cutting the material head and at the time of subsequent handling of the obtained unit heads.

Apparently, the width of the protective layer is reduced only at the cutting line. Thus, the protective layer can still provide an intended protective function.

Preferably, the protective layer has an additional cutout extending from the other longitudinal edge of the protective layer toward the array of heating dot portions at the position of the cutting line. The additional cutout further reduces the width of the protective layer at the cutting line.

Further, due to the provision of the cutout at the cutting line, the electrodes in each unit head are preferably inclined toward each other as they extends away from the array of heating dot portions. Due to such an arrangement, the cutout can clear the electrodes without the necesssity of increasing the spacing between the two adjacent heating dot portions on both sides of the cutting line.

In case the material head further comprises a glaze layer formed on the substrate for carrying the array of heating dot portions together with the pairs of electrodes, the glaze layer may preferably have a cutout which extends from at least one longitudinal edge of the glaze layer toward the array of heating dot portions at the position of the cutting line. It is further advantageous if the glaze layer has an additional cutout extending from the other longitudinal edge of the glaze layer toward the array of heating dot portions at the position of the cutting line.

Obviously, the cutout or cutouts of the glaze layer will greatly reduce the cutting length for that layer. Thus, the glaze layer can be less liable to chip formation at the time of and after cutting the material head, thereby preventing deterioration of product quality.

Other objects, features and advantages of the present invention will be fully understood from the following detailed description given with reference to the accompanying drawings.

DESCRIPTION OF THE PREFERRED EMBODIMENTS

Figure 1:
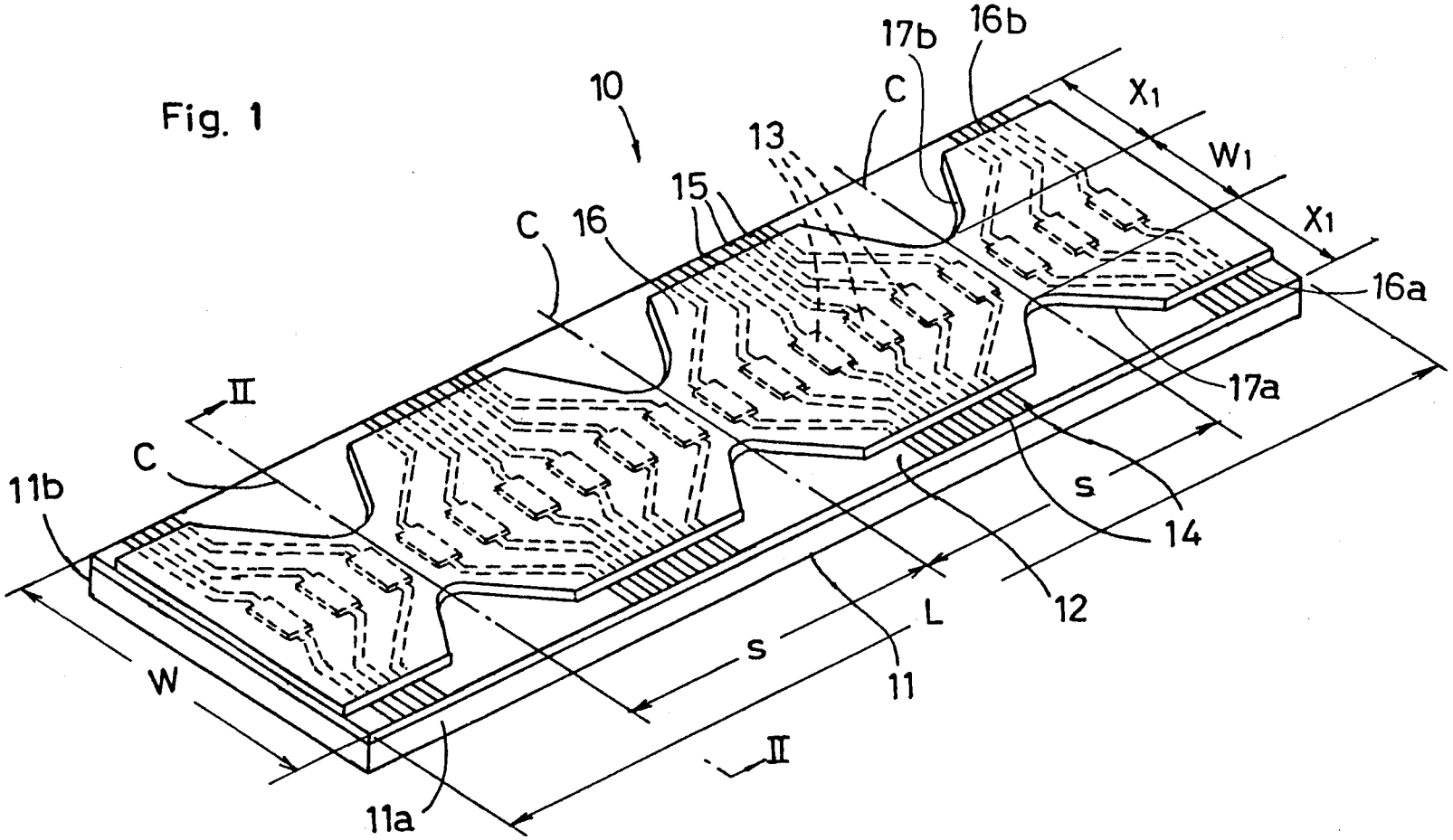
FIG. 1 is a perspective view showing a material head embodying the present invention.
Figure 2:
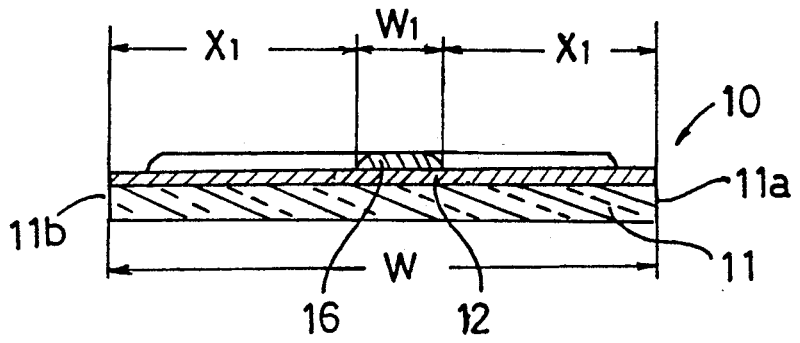
FIG. 2 is a sectional view taken along lines II—II in FIG. 1.
Figure 3:
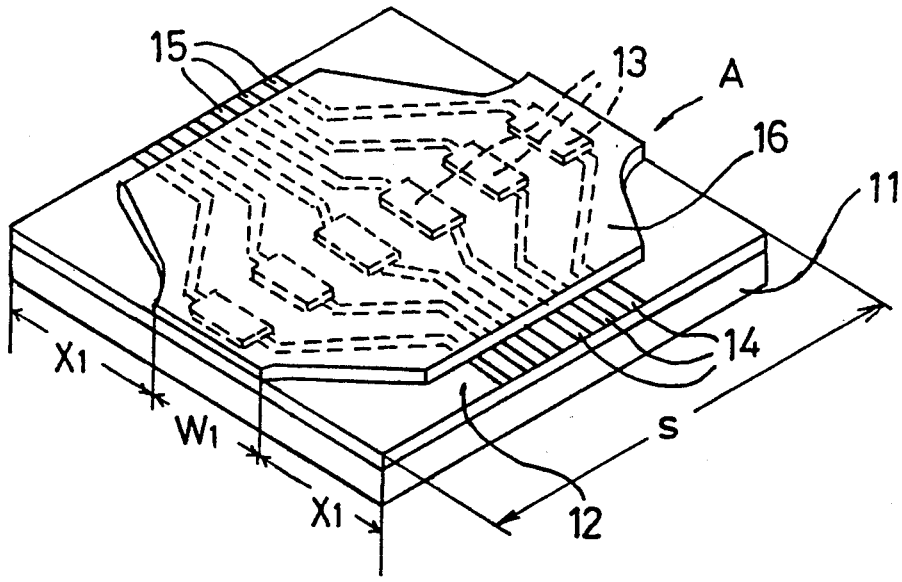
FIG. 3 is a perspective view showing a unit head obtained from the material head of FIG. 1.

Referring first to FIGS. 1 to 3 showing a first embodiment of the present invention, there is illustrated an elongate material head 10 having an overall length L and a width W. The material head comprises an insulating substrate 11 and a glaze layer 12 formed on the upper surface of the substrate. The glaze layer may be made of glass for example.

On the upper surface of the glaze layer 12 is formed an array of heating dot portions 13 arranged at suitable pitch. Each heating dot portion has a pair of electrodes 14, 15 extending toward the respective longitudinal edges 11*a*, 11*b* of the substrate 11 (head 10).

If acceptable, the glaze layer 12 may be omitted. In this case, the array of heating dot portions 13 together with the associated electrodes 14, 15 may be formed directly on the upper surface of the insulating substrate 11.

A protective layer 16 is further formed on the upper surface of the glaze layer 12 to cover the array of heating dot portions 13 together with the associated electrodes 14, 15. The protective layer is made of glass for example.

In manufacture of unit heads, the material head 10 is cut transversely along cutting lines C by a suitable cutting device such as diamond cutter. The cutting lines C are spaced longitudinally of the material head, and each cutting line extends between two adjacent heating dot portions 13. As a result, the material head is divided into a plurality of unit heads A (only one shown in FIG. 3) each having a divided length s.

According to the embodiment of FIGS. 1–3, the protective layer 16 has a pair of generally V-shaped cutouts 17*a*, 17*b* at each cutting line C. Specifically, the pair of cutouts 17*a*, 17*b* extend from the respective longitudinal edges 16*a*, 16*b* of the protective layer 16 toward the array of heating dot portions 13. Thus, the width of the protective layer is greatly reduced at the cutting line C.

As a result of forming the V-shaped cutouts 17*a*, 17*b*, the electrodes 14, 15 in each unit head A (which is provided after cutting) are inclined toward each other as they extend away from the array of heating dot portions 13 (see FIG. 1). In this way, all of the electrodes 14, 15 are covered by the protective layer 16, and the cutouts 17*a*, 17*b* are located clear of the electrodes.

With the arrangement described above, the protective layer 16 is made to have a reduced width W1 (see FIG. 1) at each cutting line C. If the distance from the bottom of each cutout 17*a*, 17*b* to a corresponding longitudinal edge 11*a*, 11*b* of the substrate 11 is represented by X1, the reduced width W1 of the protective layer is given by W-2(X1), wherein W represents the width of the material head 10. Thus, the cutting length for the protective layer is correspondingly reduced.

Obviously, the amount of chipping with respect to the protective layer 16 is greatly reduced at the time of cutting the material head 10 along the respective cutting lines C. Further, the protective layer 16 is also less liable to chipping during subsequent handling of each unit head A.

Figure 4:
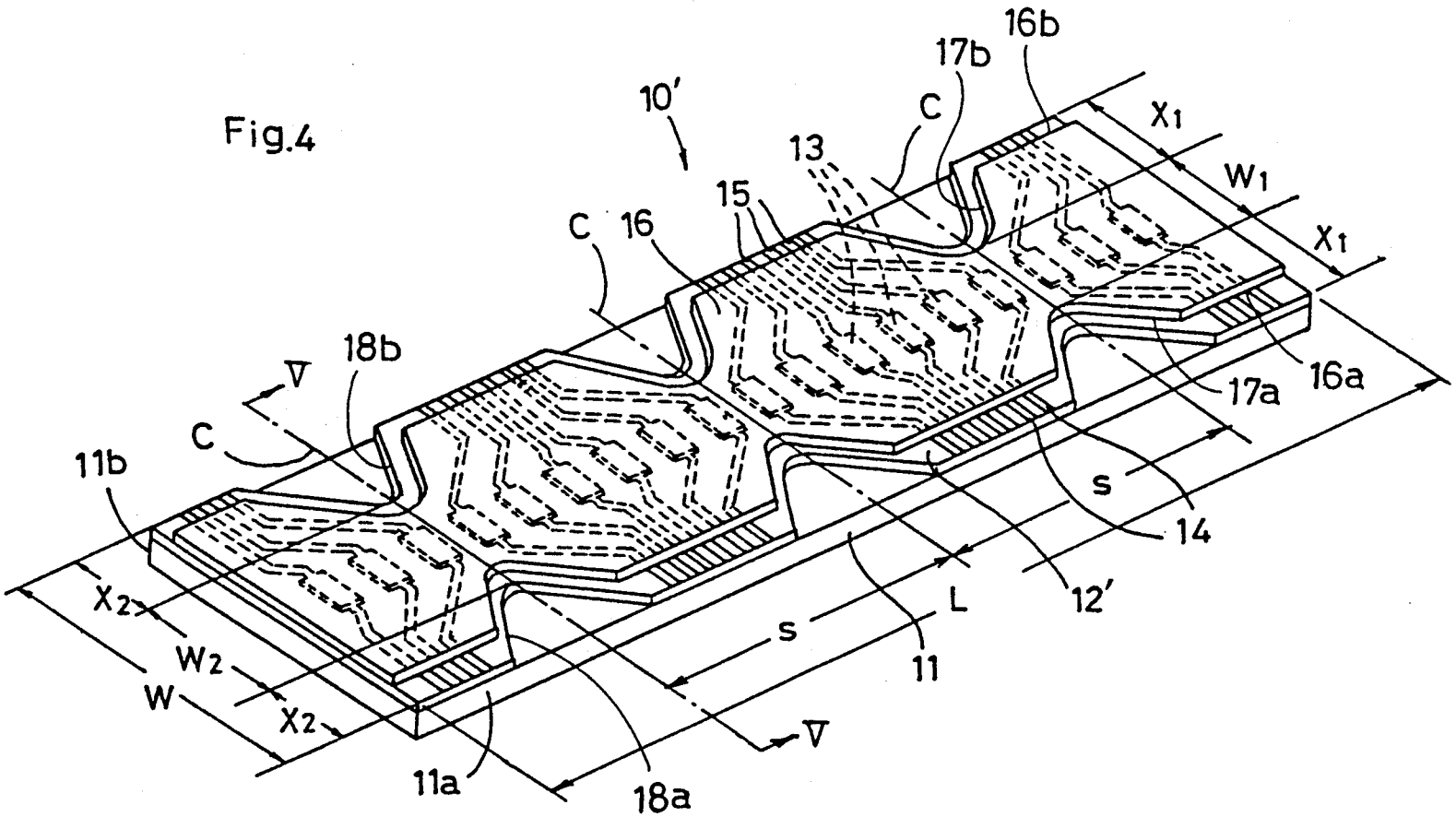
FIG. 4 is a perspective view showing another material head embodying the present invention.
Figure 5:
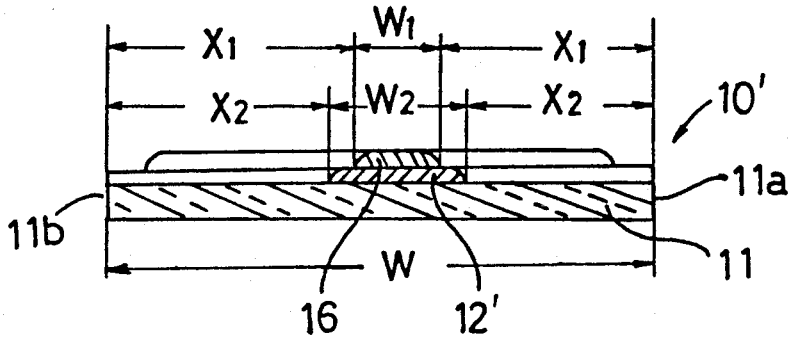
FIG. 5 is a sectional view taken on lines V—V in FIG. 4.
Figure 6:
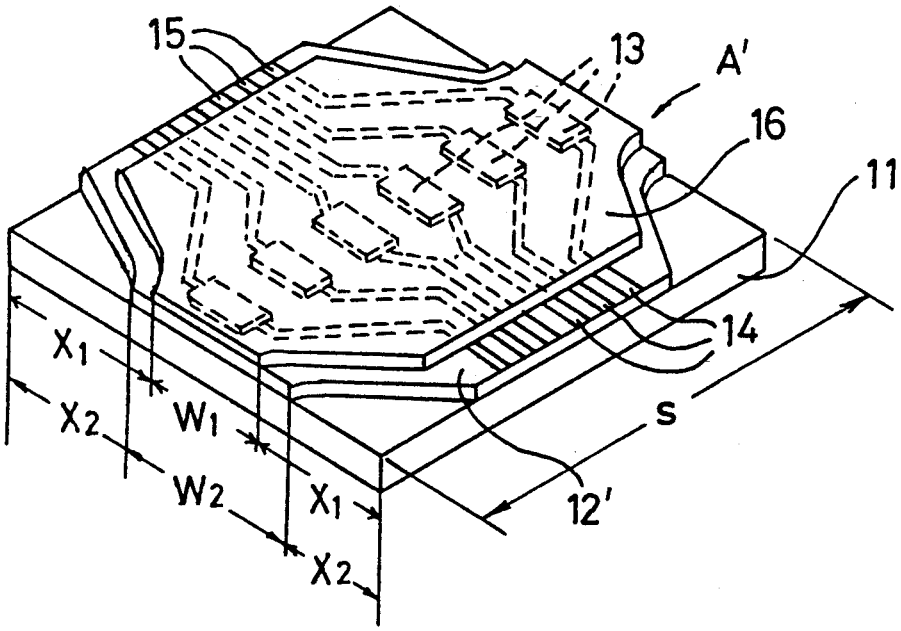
FIG. 6 is a perspective view showing a unit head obtained from the material head of FIG. 4.
Figure 7:
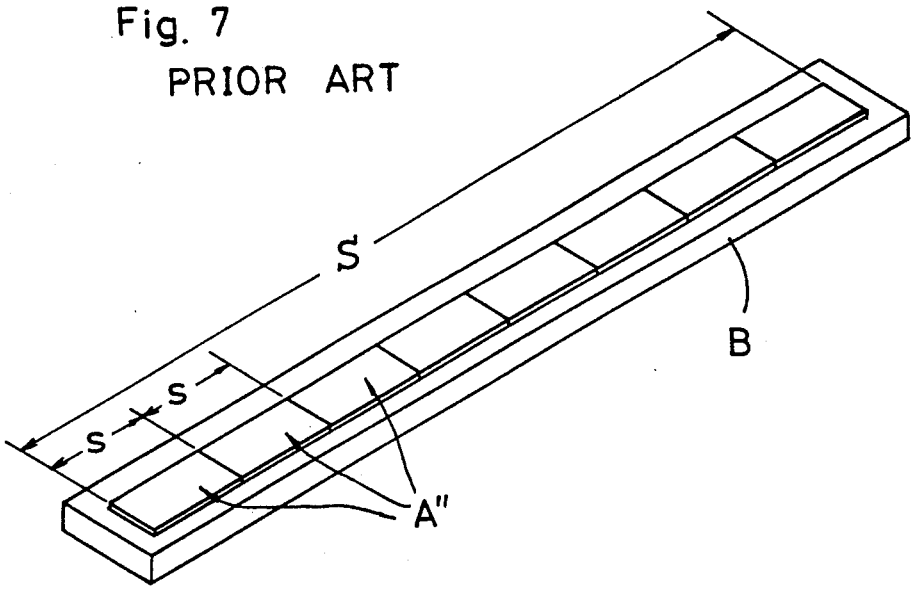
Fig. 7 PRIOR ART
FIG. 7 is a perspective view showing a prior art divisional-type thermal head.
Figure 8:
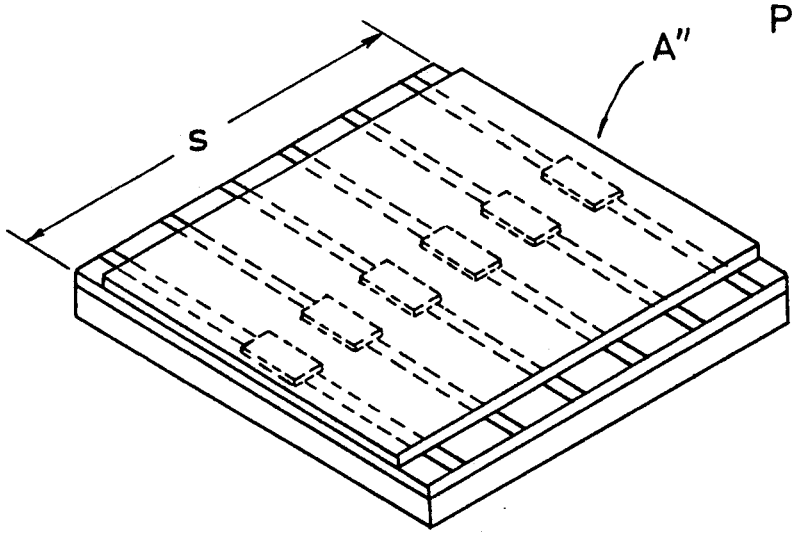
Fig. 8 PRIOR ART
FIG. 8 is a perspective view showing a unit head incorporated in the prior art divisional-type thermal head.
Figure 9:
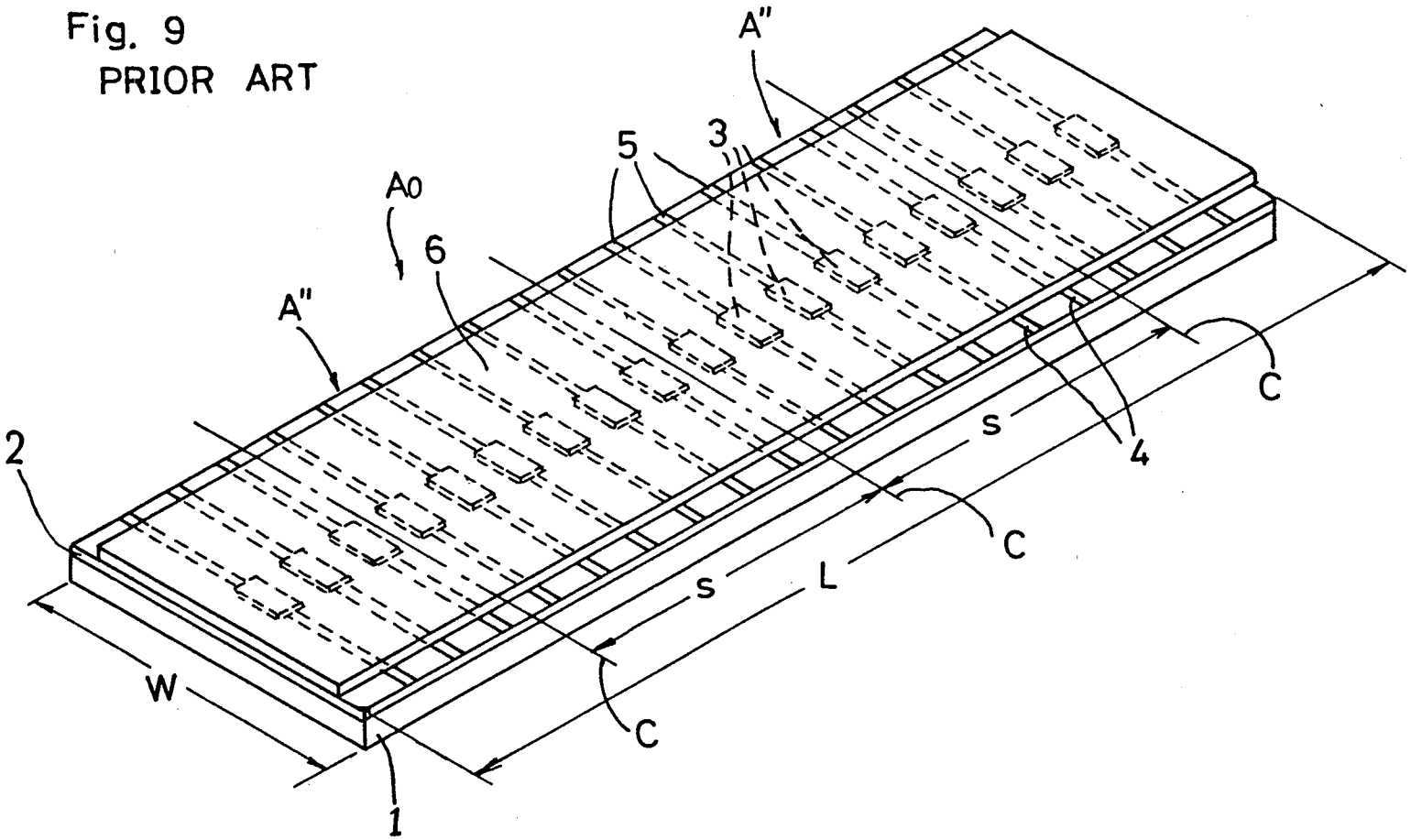
Fig. 9 PRIOR ART
FIG. 9 is a perspective view showing how the unit head is made from a material head according to the prior art method.

FIGS. 4 to 6 show a second embodiment which utilizes another material head 10'. Similarly to the first embodiment, the material head 10' comprises an insulating substrate 11, a glaze layer 12', and a protective layer 16. The glaze layer 12' carries an array of heating dot portions 13 together with their associated electrodes 14, 15. Further, the protective layer 16 has a pair of width reducing cutouts 17*a*, 17*b* at each cutting line C. The reduced width W1 of the protective layer 16 is given by W-2(X1), as defined for the first embodiment.

According to the second embodiment, the glaze layer 12' also has a pair of width reducing cutouts 18*a*, 18*b* at each cutting line C. The pair of cutouts 18*a*, 18*b* extend from the respective longitudinal edges 11*a*, 11*b* of the substrate 11 (corresponding to the longitudinal edges of the glaze layer 12' itself) toward the array of heating dot portions 13.

If the depth of each cutout 18*a*, 18*b* is represented by X2, the reduced width W2 of the glaze layer 12' at each cutting line C is given by W-2(X2). Due to the fact that the glaze layer 12' is arranged under the protective layer 16, W2 is no smaller than W1 while X2 is no larger than X1.

In manufacture, the material head 10' is cut along the respective cutting lines C to provide a plurality of unit heads A' (only one shown in FIG. 6). Obviously, due to the provision of the cutouts 17*a*, 17*b*, 18*a*, 18*b*, chipping is less likely to occur with respect to both the glaze layer 12' and the protective layer 16 at the time of and after cutting the material head 10'.

In the foregoing description, the term "cutout" is used only to indicate a portion where the glaze layer 12 (or 12') or the protective layer 16 is partially absent. This term should not be limitatively understood that the glaze layer or the protective layer is "later" removed partially.

In either of the first and second embodiments, the shape of each width reducing cutout 17*a*, 17*b*, 18*a*, 18*b* is optional. Indeed, the cutout may be U-shaped or otherwise shaped. The point of the present invention resides in that the width of the protective layer 16 (and optionally the glaze layer 12) is reduced at each cutting line C.

Further, in the drawings for the first and second embodiments, the respective reduced widths W1, W2 of the glaze layer 12 (or 12') and protective layer 16 are shown wider than actually are. In practice, the respective reduced widths W1, W2 may be rendered as small as about 3–6 mm if the width W of the material head 10 (or 10'') is 35 mm for example. Thus, the chipping reduction actually obtainable by the present invention is greatly significant.

The invention being thus described, it is obvious that the same may be varied in many ways. Such variations are not to be regarded as a departure from the spirit and scope of the invention, and all such modifications as would be obvious to those skilled in the art are intended to be included within the scope of the following claims.

We claim:

1. A method of making unit heads for divisional-type thermal head from a material head, the material head comprising an elongate insulating substrate which carries a longitudinal array of heating dot portions arranged at substantially constant pitch and pairs of electrodes connected to the respective dot portions, the material head further comprising a protective layer extending longitudinally of the substrate to cover the array of heat dot portions and the pairs of electrodes, the method comprising dividing the material head into a plurality of unit heads by cutting the material head along at least one cutting line which extends transversely of the substrate at a position between two adjacent heating dot portions, wherein the protective layer has a cutout which extends from at least one longitudinal edge of the protective layer toward the array of heating dot portions at the position of the cutting line, the cutout being wider than the pitch between said two adjacent heating dot portions, and wherein the electrodes in each unit head are inclined toward each other as they extend away from the array of heating dot portions.

2. The method according to claim 1, wherein the cutout is generally V-shaped.

3. The method according to claim 1, wherein the protective layer has an additional cutout extending from the other longitudinal edge of the protective layer toward the array of heating dot portions at the position of the cutting line, the additional cutout being wider than the pitch between said two adjacent heating dot portions.

4. The method according to claim 1, wherein the material head further comprises a glaze layer formed on the substrate, the array of heating dot portions together with the pairs of electrodes being formed on the glaze layer.

5. The method according to claim 4, wherein the glaze layer has a cutout which extends from at least one longitudinal edge of the glaze layer toward the array of heating dot portions at the position of the cutting line, the cutout of the glaze layer being wider than the pitch between said two adjacent heating dot portions.

6. The method according to claim 5, wherein the cutout of the glaze layer is generally V-shaped.

7. The method according to claim 5, wherein the glaze layer has an additional cutout extending from the other longitudinal edge of the glaze layer toward the array of heating dot portions at the position of the cutting line, the additional cutout of the glaze layer being wider than the pitch between said two adjacent heating dot portions.

* * * * *